United States Patent [19]

Testa

[11] Patent Number: 4,775,819

[45] Date of Patent: Oct. 4, 1988

[54] MASK TYPE COLOR TELEVISION TUBE AND METHOD OF MANUFACTURING THE SAME

[75] Inventor: Pierluigi Testa, Rome, Italy

[73] Assignee: Videocolor, Montrouge, France

[21] Appl. No.: 921,427

[22] Filed: Oct. 22, 1986

[30] Foreign Application Priority Data

Oct. 22, 1985 [FR] France ..... 85 15666

[51] Int. Cl.[4] ..... H01J 29/07

[52] U.S. Cl. ..... 313/402; 313/408; 445/47

[58] Field of Search ..... 313/402, 403, 407, 408; 445/47

[56] References Cited

U.S. PATENT DOCUMENTS 4,636,683 1/1987 Tokita et al. ..... 313/408 X

FOREIGN PATENT DOCUMENTS 2450734 4/1976 Fed. Rep. of Germany .
2565028 5/1985 France .

OTHER PUBLICATIONS

Journal of the Television Society, vol. 8, No. 11, Jul.-/Sep. 1958, pp. 470-480; S. H. Kaplan: "Error Correction in Mask Type Colour Television Tubes", p. 477, Avant Dernier Paragraphe.

Patents Abstracts of Japan, vol. 6, No. 230 (E-142) [1108], 16 Nov. 1982; & JP-A-57 132 641 (Nippon Denki K.K.), 17.08.1982.

Patents Abstracts of Japan, vol. 8, No. 99 (E-243) [1536], 10 May 1984; & JP-A-59 16 249 (Mitsubishi Denki K.K.), 27.01.1984.

*Primary Examiner*—David K. Moore
*Assistant Examiner*—Sandra L. O'Shea
*Attorney, Agent, or Firm*—Oblon, Fisher, Spivak, McClelland, & Maier

[57] ABSTRACT

Color television tube provided with a perforated mask and three aligned electron guns, the openings of the mask far from the center of the mask having a major axis inclined with respect to the vertical, the inclination $\alpha$ increasing with the distance from the center and this inclination being in the direction opposite to that of the image of a non-inclined slot of the mask that would be produced on the screen, by an optical projection system simulating the tube deflector.

6 Claims, 1 Drawing Sheet

MASK TYPE COLOR TELEVISION TUBE AND METHOD OF MANUFACTURING THE SAME

BACKGROUND OF THE INVENTION

Field of the invention

The invention relates to a mask type color television tube and its method of manufacturing the same. It concerns more particularly a color television tube in which the three electron guns are aligned, i.e. the axes of said guns are positioned in one common plane.

A color television tube comprises a frontal panel upon the internal face of which is deposited the screen which is usually formed of vertical bands of cathodoluminescent substances (phosphors) emitting, when they are excited by an electron beam produced by an electron gun, a red, green or blue color light. The screen thus comprises a succession of assemblies comprising three vertical bands, each assembly presenting a red band, a green band and a blue band. Each color is excited by a corresponding electron beam. In one particular type of tube, often known as a "matrix", two adjacent bands of phosphors are separated by a black graphite band, thereby allowing to obtain an improved contrast image. In a mask tube, with a view to selecting the colors, in such a manner that the beam associated to one color, for example, blue, only strikes the phosphor adapted to produce this color (blue), a perforated mask is provided in front of the screen of which the position and the disposition of the openings, generally elongated slots extending in the vertical direction ensure the said color selection.

Since the position of the mask with respect to the screen must be accurately determined, the mask is used in order to form the screen and, with this purpose, it is secured to the panel of the tube prior to the formation of the screen. Each of the luminescent substances is thus deposited in the following manner: the internal face of the screen is coated with a solution of the substance in a photosensitive material that hardens when it is illuminated by an ultra-violet radiation (UV), then this solution is illuminated by an optical system that comprises an UV radiation source and an objective simulating the tube deflector. The position of the optical system, especially of the UV lamp, depends upon the color of the phosphor in solution. In this manner, only the photosensitive material present at the sites provided for the determined color is illuminated and can thus harden. The material present in the other sites does not harden and does not adhere to the glass; it can be cleaned by washing with water or another convenient liquid.

The mask being provided with slots disposed in succession along vertical lines, it is necessary, in order to form on the screen continuous vertical lines, to displace the UV source in the vertical direction during illumination.

It has been noted that the phosphor bands, or graphite bands, adjacent to the corners of the rectangular screen have an irregular appearance, thereby impairing the quality of the image in these zones.

This deficiency results from the deformations due to the optical system used for projecting the UV light, these deformations increasing with the distance between each dot of the screen and the axis of the tube and with the distance between each of these dots and the horizontal median plane. In particular, in the vicinity of a vertical edge of the screen, the image of a vertical slot of the mask is, on the horizontal median line, a spot that is also vertical; but, in the vicinity of the edges the image of a vertical slot of the mask is an inclined spot. Therefore, after the slight displacement of the UV source with respect to the optical projection system, close to the vertical edges of the screen, irregular phosphor or graphite lines or bands will appear, that are wider towards the corners than at the center.

In order to overcome this deficiency, a cylindrical lens is usually provided in the optical system for projecting the UV light. However, such a cylindrical lens is a costly element and, furthermore, does not give entirely satisfactory results.

OBJECT OF THE INVENTION

Now, the present invention overcomes this deficiency in a simple and economical manner.

According to one characteristic feature of the invention the slots of the mask are positioned and shaped in such a manner that their images on the screen are, over the entire surface of said screen, disposed along vertical lines with a constant width. This means that, contrary to the masks of tubes known up to now, the mask of the tube according to the invention does not present, over its whole surface, slots of which the major axes are vertical lines; however, certain of these slots, especially those that are in the vicinity of the corners, have major axes that are inclined with respect to the vertical; furthermore, the edges of the slots adjacent to the center are rectilinear whereas the edges of the slots in the vicinity of the corners are curved.

In order to determine the inclination and the form of the slots, it is possible to proceed in an experimental manner by performing tests or even by means of a computed program determining the trajectory of the luminous rays which, issuing from the optical system, form on the screen regular vertical images, having a constant width; the form, the position and the dimensions of each slot are thus determined by the intersection of a luminous beam with the surface that constitutes the mask.

It has been noted that the inclination to be conferred upon each slot of the mask is opposite to the inclination of the image on the screen of a slot of a mask that would be at the same site, but not inclined.

BRIEF DESCRIPTION OF THE DRAWINGS

Other advantages, features and objects of the invention will become apparent from the following description of certain of its embodiments given with reference to/the appended drawings in which.

DETAILED DESCRIPTION OF A PREFERRED EMBODIMENT

Figure 1:
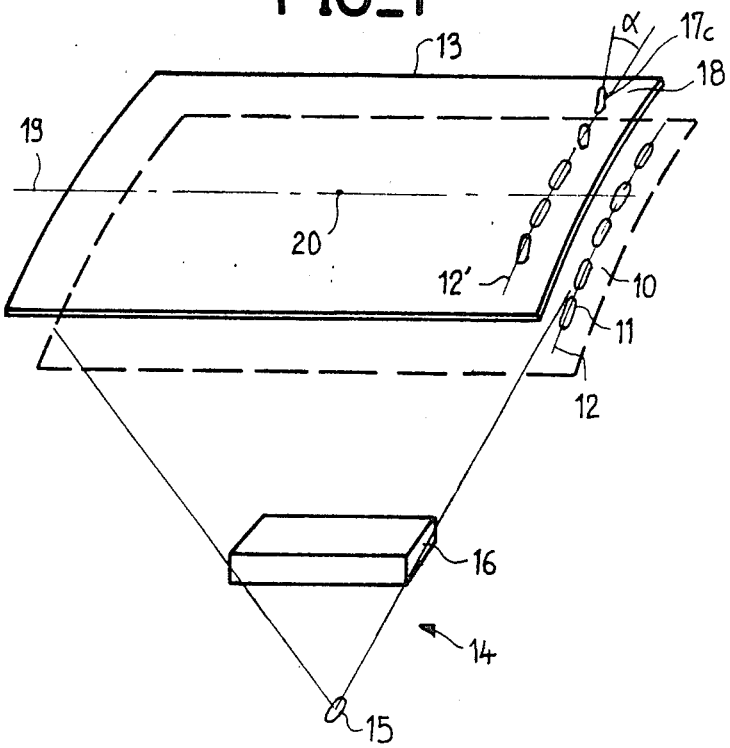
FIG. 1 is a perspective view showing a color television tube screen and mask during manufacture of the screen; and, FIG. 2 is a diagram of a mask according to the invention.

The mask 10 (FIG. 1) of a color television tube (not represented in its entirety) known up to now, comprises elongated slots 11 disposed in rows according to lines 12 which, during the normal utilization of the television receiver, constitute vertical lines. The major axes of the slots of a given row coincide with the corresponding line 12. These slots of the known mask also all have the same width and rectilinear vertical edges.

For the formation of the screen on the frontal panel 13 of the glass shell or envelope constituting the tube, prior to assembling this glass panel to the rest of the shell, the mask 10 is secured to this panel 13 of which the internal face has previously been coated with a photosensitive material that hardens under ultra-violet light and contains one of the phosphors. Thereafter, this assembly is associated to an optical system 14 comprising an ultra-violet source 15 and a projecting device 16 simulating the deflector of the tube that will finally be manufactured, so that the UV rays have the direction of the electron beam that will be produced by the gun associated to the color of the phosphor in solution on the screen.

It will be noted that the images 17, on the screen 13, of the slots 11 of the mask are not exactly identical to these slots; in particular, the images 17*c* in the vicinity of the corners 18 have a major axis inclined at an angle $\alpha$ with respect to the corresponding vertical line 12' and, furthermore, their edges are slightly curved. The amplitude of this deficiency diminishes when the median horizontal axis 19 of the screen and of the center 20 of this latter are approached. It is to be noted, furthermore, that this deficiency is reduced when the radius of curvature of the screen increases, i.e. the deficiency is less pronounced for a flat screen.

In order to obtain an illumination according to the continuous lines of the screen 13 the source 15 is displaced parallely to lines 12. But, due to the variable inclination of the images of the slots 11 on the screen, despite this displacement of the source 15, the lines obtained on the screen do not have a constant thickness, they are thicker towards the corners than at the center.

Figure 2:
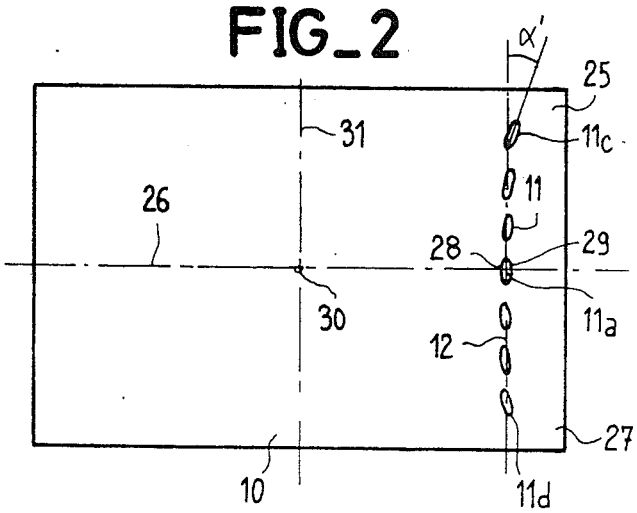

According to the invention, in order to eliminate this deficiency, the slots 11 of the mask 10 are oriented and shaped in such a manner that they are projected onto the screen 13 so as to form regular alignments of vertical axes and constant thickness over the entire surface of the screen. Thus, contrary to the mask of color television tubes known up to now, the slots 11 do not all have the same orientation. For example, (FIG. 2) the slot 11*c* located in the vicinity of the corner 25 is inclined with respect to the vertical line 12 by an angle $\alpha'$ in the opposite direction to angle $\alpha$ (FIG. 1). On the contrary, on the same vertical line 12 the central slot 11*a* on the median horizontal line 26, presents a major axis according to FIG. 12. On the same line 12, the slot 11*d* adjacent to the lower right corner 27 presents a major axis of which the inclination with respect to the line 12 is practically equal in 20 absolute value to the angle $\alpha'$ but in the opposite direction, the line 26 constituting an axis of symmetry for the mask. The longitudinal edges 28 and 29 of the slot 11*a* are rectilinear. On the contrary, the corresponding edges of the slots 11*c* and 11*d* have a slightly convex curvature.

It is to be noted that the mask 10 presents a vertical axis of symmetry 31 passing through the center 30.

In order to determine the inclination and the form of the slots 11 of the mask 10 it is possible to proceed in an empirical manner, i.e. by performing tests with various slot inclinations and various curvatures of their edges. This determination can also be performed by calculation by means of a program in which are stored in memory the various luminous paths issuing from the optical system 14 and determining the intersection with the mask 10 of the luminous rays that supply the luminous spots on the screen 13 of which the major axis is always on the vertical 12 and has the same thickness (dimension according to the horizontal axis) over the entire height of the screen. In order to establish such a program, it is sufficient to make use of the well known optical laws as applied to the optical system 14; the calculation is simplified by the fact that the luminous source 15 is generally unidimensional, i.e. constituted by a segment of a straight line. In the present case, for example, it has been supposed that the source was formed of a limited number of dots and for each of these dots and for each ray direction emitted by these dots, the direction of the ray issuing from the system 14, was determined. The calculation is performed, for each azimuth value by site increments, the value of the increment being selected as a function of the precision desired, the various azimuth values being furthermore separated by an incremental value selected, too, as a function of the precision desired.

It will be appreciated that the constant thickness of the lines of the phosphor or graphite on the screen 13 is obtained without in any way complicating the structure of the optical system 14. On the contrary, the optical system 14 is simplified with respect to the systems produced according to the prior art in which a cylindrical lens was provided whereas according to the present invention, no such lens is required.

The invention is particularly adapted to a color television tube in which the three electrons guns are aligned, i.e. the axes are present in a single plane.

I claim:

1. A color television tube comprising:

a screen having continuous vertical phosphor lines placed thereon; three electron guns;

a perforated mask placed between said three electron guns and said screen with the placement of the perforations being such that each electron gun only excites one determined color, the openings of the mask being disposed according to continuous vertical phosphor lines, wherein the openings of the mask that are far from the center of the mask having a major axis and a minor axis are inclined with respect to the minor axis, at an angle ($\alpha'$), this inclination, increases with the distance from the center, such that the end of said openings closer to the major axis are also closer to the minor axis than the opposite end of the same opening.

2. A tube according to claim 1, wherein the openings are provided in the vicinity of the horizontal median line of the mask have a practically vertical major axis.

3. A tube according to claim 1 or 2, wherein the openings close to the center and to the horizontal median line present vertical rectilinear edges whereas the openings of the mask in the vicinity of the corners present edges that have a slightly convex curvature.

4. A method of manufacturing a color television tube comprising the steps of:

positioning a screen having continuous vertical lines of phosphor thereon;

positioning three aligned electron guns in said tube;

positioning a perforated mask between said electron guns and said screen such that the perforations are disposed and arranged so that each electron beam only reaches the phosphors of a corresponding color on the screen;

utilizing said mask during the manufacture of the tube, for the formation by means of an optical system simulating the tube deflector, the vertical lines of phosphors and possibly of graphite between these vertical lines, on the screen coated with a solution of phosphor or graphite in a photohardening material, wherein the position and the configuration of each opening of the mask is such that during the manufacture each of these openings creates on the screen a projection by the optical system, of an image having a major axis and a minor axis and a constant thickness in horizontal direction, the inclination ($\alpha'$) of each opening of the mask being opposite to the inclination ($\alpha$) of the image on the screen of a noninclined opening, such that the end of said openings closer to the major axis are also closer to the minor axis than the opposite end of the same opening, which would be produced at the same site by the optical system.

5. A method for producing a tube according to claim 4, wherein the position and the configuration of each opening in said mask are determined in an empirical manner.

6. A method for producing a tube according to claim 4, wherein the openings of the mask are calculated by determining the intersection with the mask of those of the luminous rays emitted by the optical system that will be projected according to the spots on the screen having a vertical major axis and constant thickness.

* * * * *